United States Patent [19]

Seaborn

[11] 4,367,117

[45] Jan. 4, 1983

[54] MACHINE FOR SEALING DISC COVERS

[75] Inventor: Paul E. Seaborn, Los Gatos, Calif.

[73] Assignee: Discover Technology, Inc., Campbell, Calif.

[21] Appl. No.: 243,834

[22] Filed: Mar. 16, 1981

[51] Int. Cl.[3] ..... B65C 1/00

[52] U.S. Cl. ..... 156/443; 156/217; 156/227; 156/477 R; 156/578; 156/499; 493/131

[58] Field of Search ..... 156/578, 443, 461, 464, 156/475, 477 R, 479, 441.5, 442.1, 442.2, 442.3, 217, 227; 53/376, 377, 371, 382, 383, 479, 482; 493/131

[56] References Cited

U.S. PATENT DOCUMENTS

| | | | |
|---|---|---|---|
| 2,898,816 | 8/1959 | Keely | 156/357 X |
| 3,395,624 | 8/1968 | Seyl | 53/376 X |
| 3,861,124 | 1/1975 | Beutyien | 156/443 X |
| 4,035,224 | 7/1977 | Anderson | 156/475 |
| 4,075,821 | 2/1978 | Cavell | 156/578 X |
| 4,272,235 | 6/1981 | Barnett | 156/443 X |
| 4,307,621 | 12/1981 | Appoldt et al. | 156/443 |

*Primary Examiner*—David A. Simmons
*Attorney, Agent, or Firm*—Gerald L. Moore

[57] ABSTRACT

Covers for floppy discs and like media are first formed with three sides sealed and thereafter the disc is inserted. A fourth flap must then be folded and glued for permanent sealing of the disc. The subject machine receives the unsealed cover with the disc inserted and folds and glues the flap to seal the disc in the cover.

3 Claims, 13 Drawing Figures

FIG 5
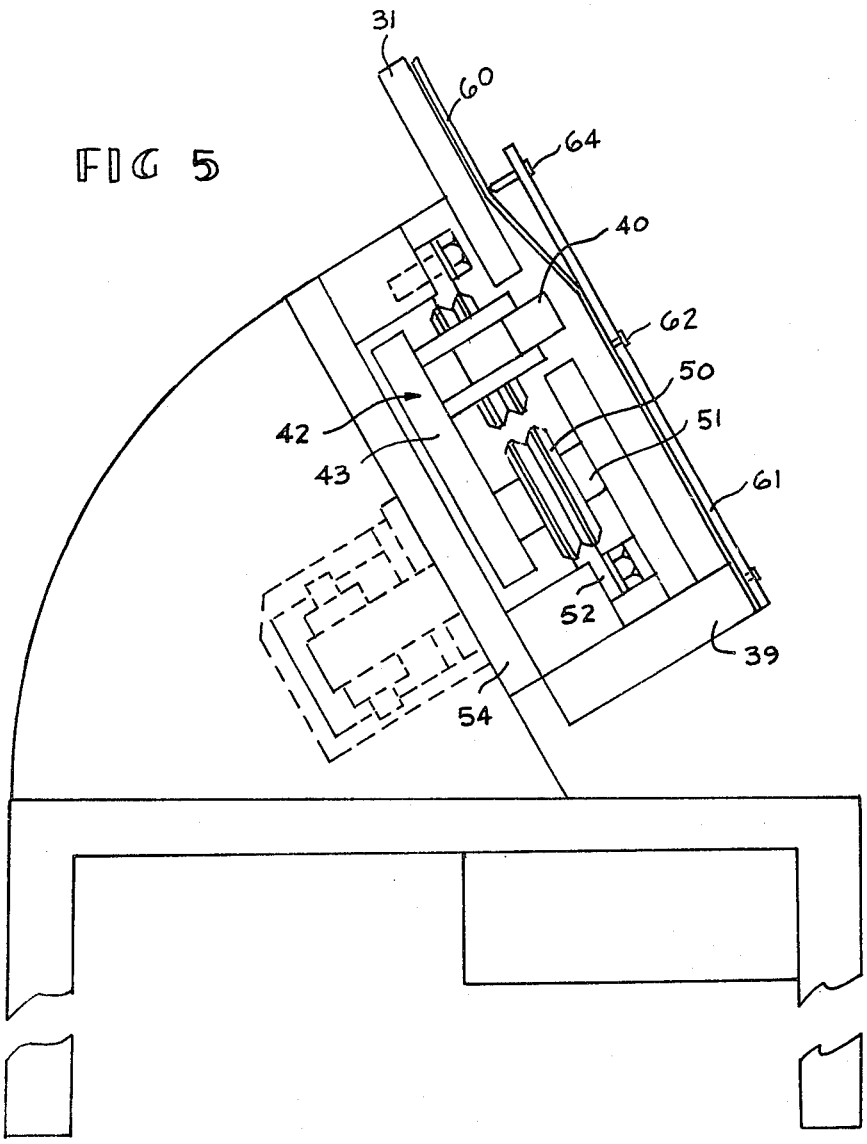
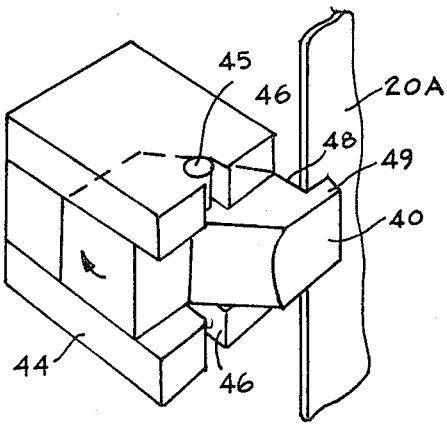
FIG 6
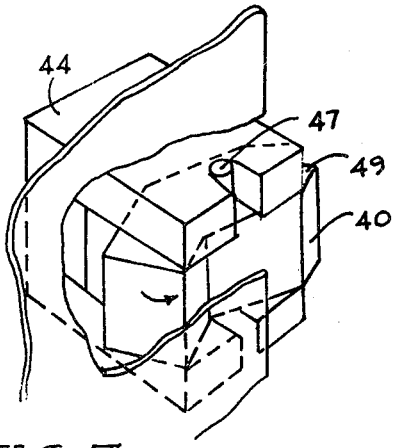
FIG 7

MACHINE FOR SEALING DISC COVERS

TECHNICAL FIELD

This invention relates to a machine for sealing the covers enclosing recording discs.

BACKGROUND ART

Recording media such as floppy discs are enclosed in a flexible cover with the edges sealed to protect the disc. Access to the disc is available through an opening in the middle and through a slot extending radially outward from the center opening in the cover to allow a read/write head to be brought into engagement with the disc surface for the transfer of information as the disc is roatated.

For a read/write process, the disc and cover are inserted into the machine and contact is made with the center of the disc through the cover opening for spinning the disc. The cover is held stationary and the read/write head is moved radially across the disc through the slot. The disc spins within the stationary cover and it is important to maintain the frictional engagement therebetween at a minimum.

The present invention is provided for sealing the disc cover after the disc has been inserted. The disc cover is formed in the manner described in U.S. Pat. Application Ser. No. 228,460, filed on Jan. 26, 1981, and entitled: *MACHINE FOR FOLDING RECORDING DISC COVERS* with Paul Edward Seaborn as inventor and assigned to the same assignee as this application. As can be seen by study of that patent application, the disc cover is formed in a manner to provide sufficient space for the disc by folding the disc cover about a mandrel. After the disc is inserted in this formed cover it is similarly important to complete the sealing of the cover in a manner to provide for sufficient space for the disc and also to accomplish the sealing in a manner such that no glue or adhesive reaches the outside of the disc cover, and especially does not contact the interior of the cover so as to interfere with the rotation of the disc.

It is the purpose of the present invention to provide a machine for sealing disc covers in an efficient manner to provide satisfactory space for rotation of the disc.

DISCLOSURE OF INVENTION

A machine for sealing a disc cover around the disc and wherein the disc cover includes first and second parallel-positioned walls enclosing the disc with a flap fixed to one wall which, after insertion of the dsic, must be folded around and glued to the second wall for sealing the cover. The machine includes a platen on which the disc cover is placed with means for heating the fold line of the flap and for contacting and folding the flap around the adjoining disc cover wall. Thereafter means are provided for lifting the flap and a glue nozzle passes thereunder the depositing glue between the flap and the cover wall. Subsequently a press is brought into engagement with the flap for forming a tight joint between the flap and the wall to complete the sealing operation.

BRIEF DESCRIPTION OF DRAWINGS

FIG.5 is an enlarged end view of the machine of FIG. 3;

FIGS. 6 and 7 are enlarged perspective views of the detents for shifting the disc covers along the platen;

DESCRIPTION OF THE INVENTION

Figure 1:
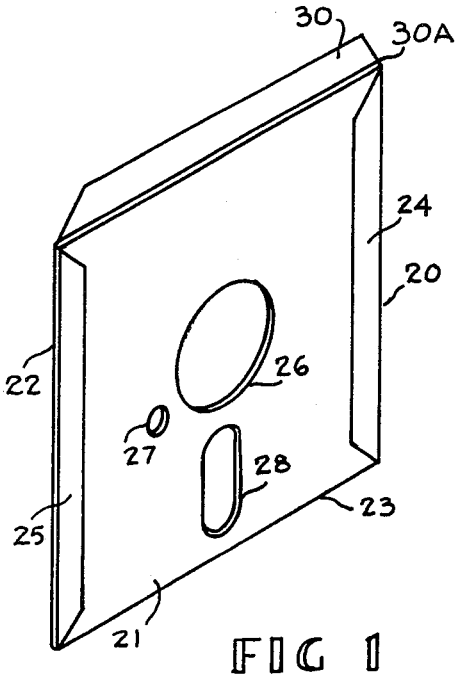
FIG. 1 is a perspective view of the formed disc cover with one side flap unsealed.

In FIG. 1 is shown a floppy disc cover 20 comprising first and second side panels 21 and 22 joined at the fold line 23. The side panel 22 includes the side flaps 24 and 25 which are folded around the first side panel 21 and glued thereto. Both walls include a center hole 26, an index hole 27 and a read/write head access slot 28.

Figure 2:
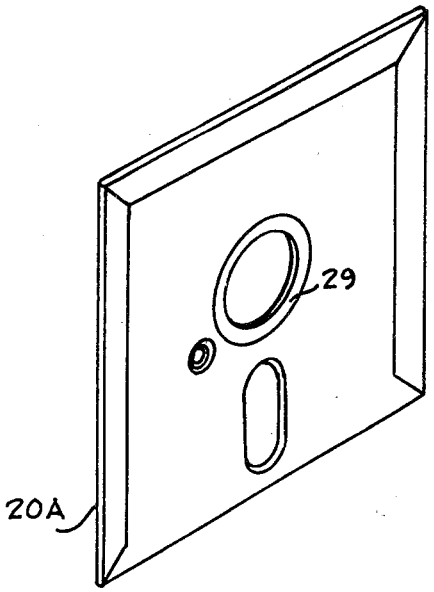
FIG. 2 shows the disc cover sealed with the disc inside.

A disc 29 (FIG. 2) is placed within the cover, thereafter the fold line 30A is heated and the end flap 30 is folded over the first wall 21 and glued thereto to seal the disc within the cover. The ends of this end flap are beveled to match the beveled ends of the side flaps in the manner shown in the drawings. Thus there is formed the completed cover and disc combination 20A shown in FIG. 2 to be used for the recording of data. It is the purpose of the present invention to fold and glue the end flap 30 after the disc has been placed within the disc cover.

Figure 4:
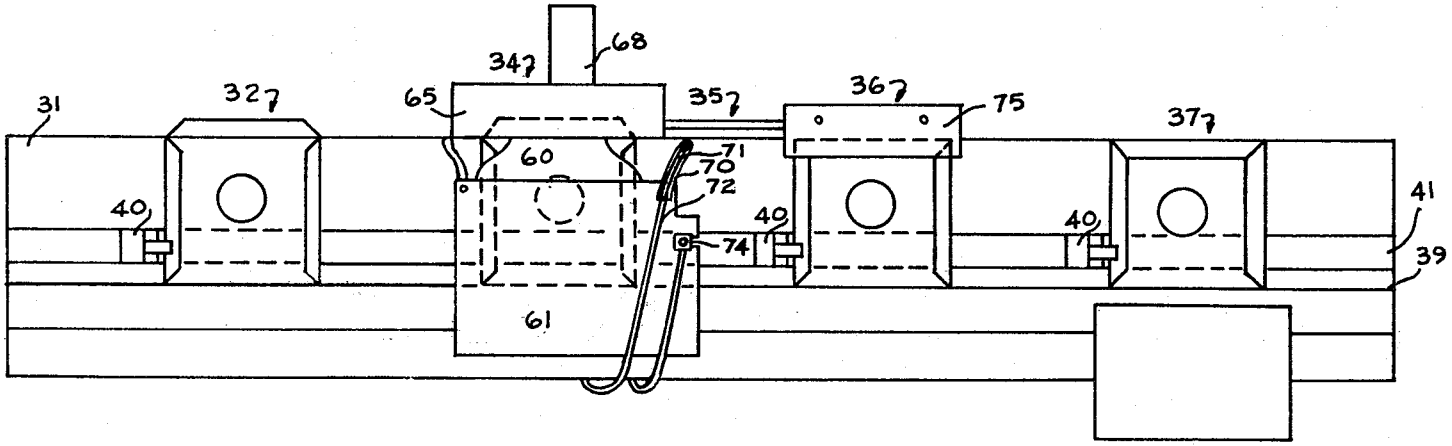
FIG. 4 is a front view of the machine of FIG. 3.

Shown in FIG. 4 is the machine for sealing the disc cover in the manner just described. The machine includes a platen 31 extending continuously through a loading station 32, a folding station 34, a glue station 35, a clamping station 36 and an unloading station 37. As illustrated in FIG. 5, the machine is supported on a plurality of legs 38 on which the platen 31 is mounted at an acute angle with the vertical such that the disc covers can lay thereon with the bottom edge supported by a guide 39. The covers are shifted through the various stations by means including a plurality of detents 40 which are moved along a slot 41 in the platen. As shown in FIG. 5 these detents are supported on a dolly 42 carrying a support plate 43 on which are mounted the parallel extending supports 44. The detents are each mounted on a respective shaft 45 (FIGS. 6 and 7) which extends into a slot 46 in each of the supports. In this manner the detents are permitted to rotate between the "driving" position shown in FIG. 6 and the "return" position shown in FIG. 7. When in the driving position, the forward edge 48 catches and pushes forward a disc cover 20A held against the platen by the lip 49 on the detent and extending parallel to the platen. When in the return position shown in FIG. 7, the detent is rotated to a position between the supports 44 so the forward edge 48 does not extend beyond the surface of the platen and interfere with any disc cover resting thereon.

Figure 3:
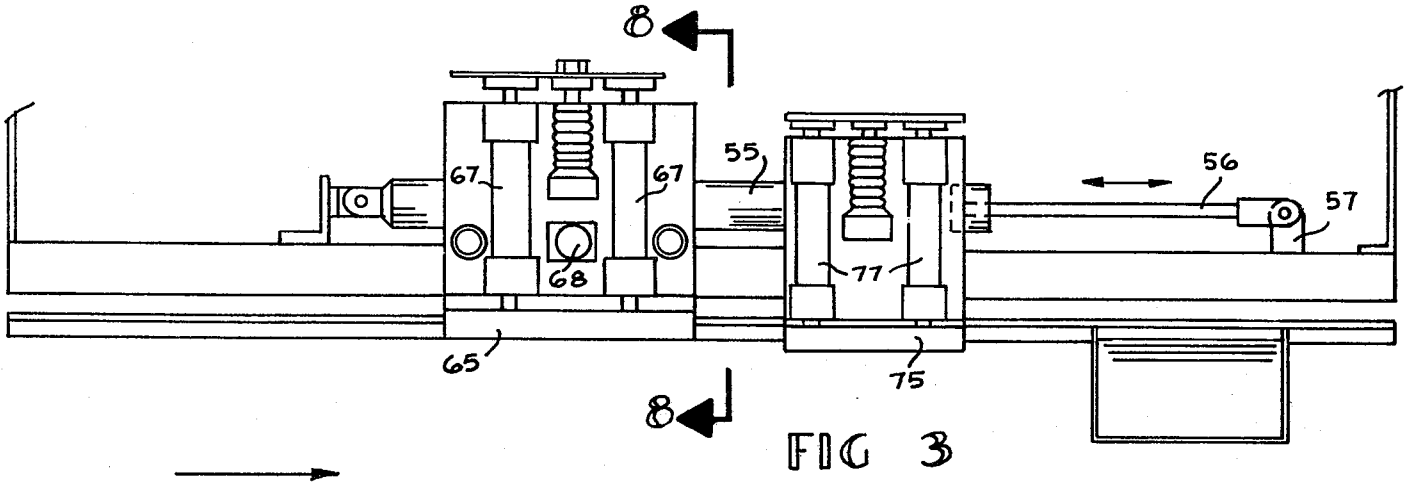
FIG. 3 is a top view of the machine embodying the subject invention.
Figure 13:
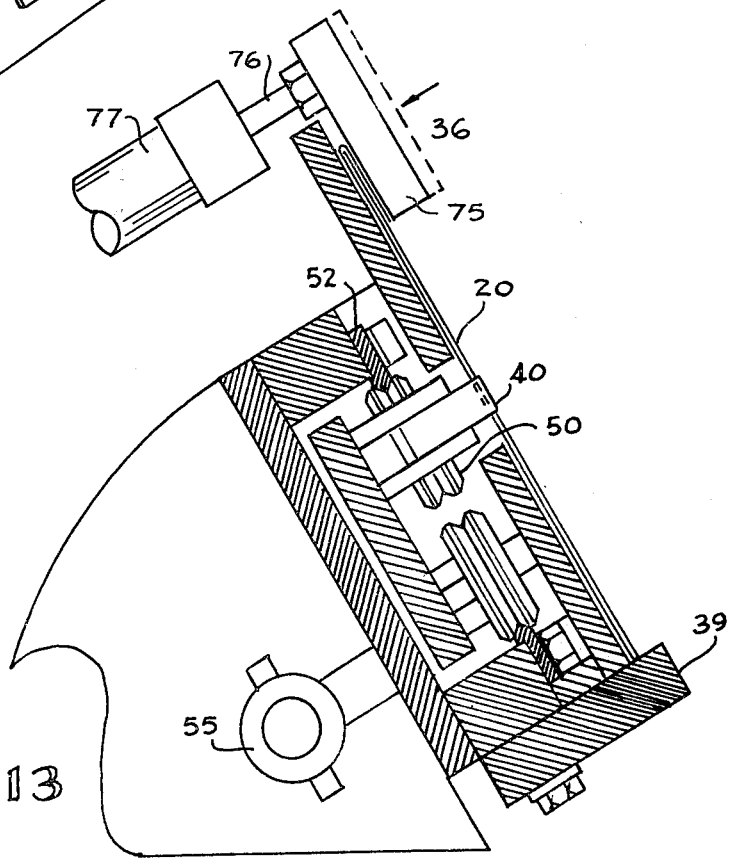
FIG. 13 is an enlarged cross-sectional view along the line 13—13 of FIG. 12.

Supporting the dolly 42 are a plurality of rollers 50 rotatably mounted to axles 51 fixed at one end to the plate 43. These rollers include a V-grooved peripheral surface which interfits with rails 52 bolted to the U-shaped main frame 54 of the machine. Thus the dolly is permitted to move lengthwise and parallel to the rear of the platen with the detents 40 extending through the slot 41 and above the platen surface. Such movement is effected by an actuator 55 (FIGS. 3 and 13) which include as actuating arm 56 fixed to an upstanding flange 57 on the dolly. By supplying pressured fluid to selected ports (not shown) of the actuator, the dolly is moved lengthwise along the platen. Such movement, when effected from left to right in FIG. 4, serves to allow the detents to pivot to the driving position and shift any disc cover along the platen the length of movement of the dolly. As the dolly is returned, the detents are rotated so as not to extend above the platen surface and contact any disc cover. Thus the disc covers are jogged forward from the loading station through the folding, glue, holding and unloading stations. After each movement of the dolly, the dolly is returned to the position to the left in the drawing while the disc covers are held at the new position. As each detent strikes the cover just moved, it pivots to the return position to clear the cover and allow it to remain stationary. There is one detent to shift a cover to each station except for the glue station which functions as the cover moves therethrough. With the disc cover at the loading station 32 and the dolly positioned to the left, energization of the actuator 55 will cause the first detent to shift the disc cover to the right (in FIG. 4) into alignment with the folding station 34. Such movement will position the disc cover beneath a mandrel 60 mounted on a front plate 61 bolted to the guide member 39. Bolts 62 (in FIG. 5) fix the mandrel to the plate and the degree of spring loading against the platen is controlled by the turning of a set screw 64 threaded through the plate 61 and pressing against the mandrel.

To fold the top flap 30 (FIG. 8) over the side wall 21, there is positioned just above the top of the platen a folding arm 65 (FIGS. 8 and 9) extending behind and parallel to the flap and supported on a mount 63 fixed to actuating arms 66 extending from a pair of actuators 67. The actuator 67 in turn is mounted on the actuating arm (not shown) of an actuator 68 extending at right angles thereto. The actuator 68 is fixed to the machine frame.

Figure 8:
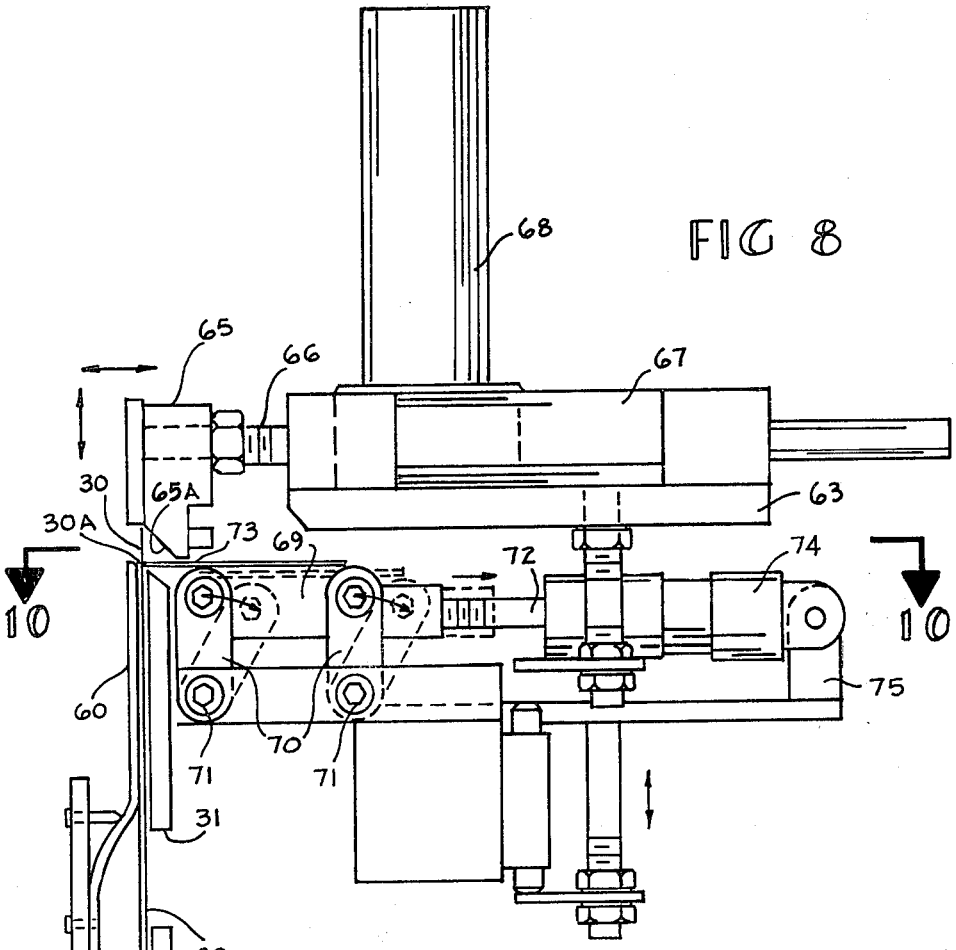
FIG. 8 is an enlarged cross-section view along the line 8—8 of FIG. 3.
Figure 9:
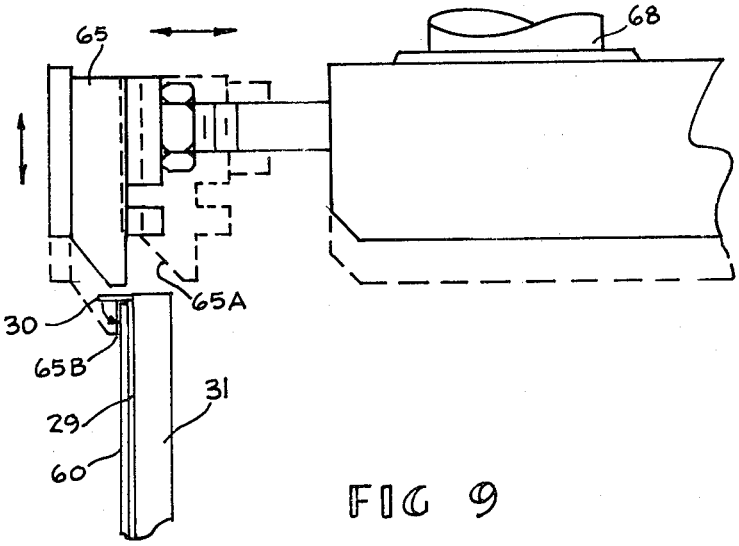
FIG. 9 is an enlarged view of the folding head of FIG. 8 showing the various positions in plantom.
Figure 10:
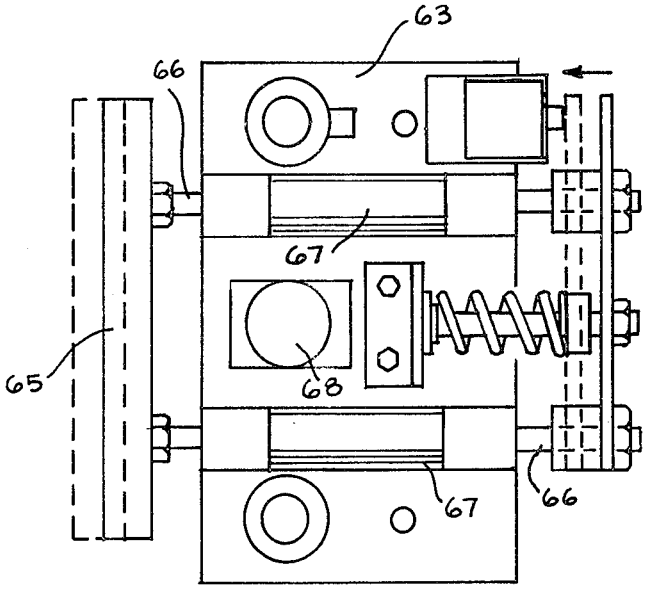
FIG. 10 is a view along the line 10—10 of FIG. 8.
Figure 11:
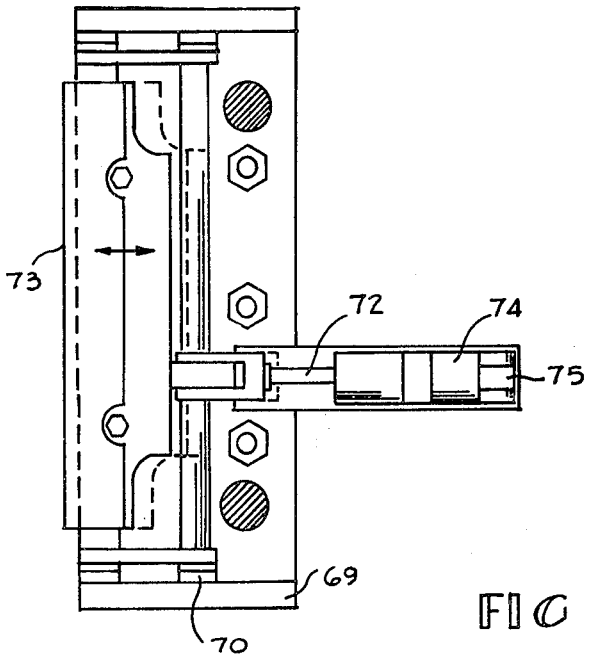
FIG. 11 shows the heater.

As explained before, the flap 30 is folded after the fold line 30A is heated. For this purpose a heater support 69 is positioned at the top edge of the platen on a plurality of pivotal levers 70 mounted on the machine frame by the shafts 71 (FIG. 8). The heater support is fixed to an actuator arm 72 extending from an actuator 74 fixed to a frame support 75. With energization of the actuator 74, the heater support is shifted by pivoting the levers counterclockwise in FIG. 8 to bring a heated knife edge 73 (fixed to the heater support) into contact with the flap 30 at the folding line 30A. After a sufficient time for the material to become heated, the actuator 74 is energized to pull the knife edge back away from the disc cover. Heat is provided to the knife edge by a heater (not shown) imbedded in the heater support 69.

Subsequent to the heating of the fold line, the actuators 67 are energized to move the folding arm 65 to the left (in FIG. 8) causing the beveled face 65A to contact and bend forward the flap 30. When the folding arm reaches the position shown in solid outline (in FIG. 9) with the flap folded at right angles to the disc cover, the actuator 68 is energized to move the mount and folding arm downward. This action moves the rear face 65B downward along the wall 21 of the disc cover to fold the flap around the mandrel 60 and vertically downward to a position parallel to the forward wall 21 of the disc cover. Because of the heating of the fold line, the flap remains substantially in this position as the folding arm is retrieved—first vertically and then horizontally—back to the initial position by sequential reverse movement of the actuators. Thus the flap 30 is folded around the mandrel 60 to provide sufficient space within the disc cover for the disc so as not to hinder subsequent rotation of the disc.

After the top flap is folded, the dolly 42 (FIG. 5) is actuated for shifting the disc cover through the glue station 35 to the clamping station 36. The glue station includes a glue system comprising a spring arm 70 (FIG. 12) with one end bolted to the plate 61 and an extending end projecting upwardly to press against the platen. The arm extends generally in the direction of travel of the disc cover with the extending end being in a position to move under the flap 30. Supported on the outer side of this arm near the projecting end is a glue nozzle 71 fixed to the end of a tube 72 extending to a glue supply. While the glue supply is not shown it preferably comprises a source of glue and energizing means to cause it to flow through the tube when desired. The energizing means is pressurized to cause the glue to flow through the tube.

Figure 12:
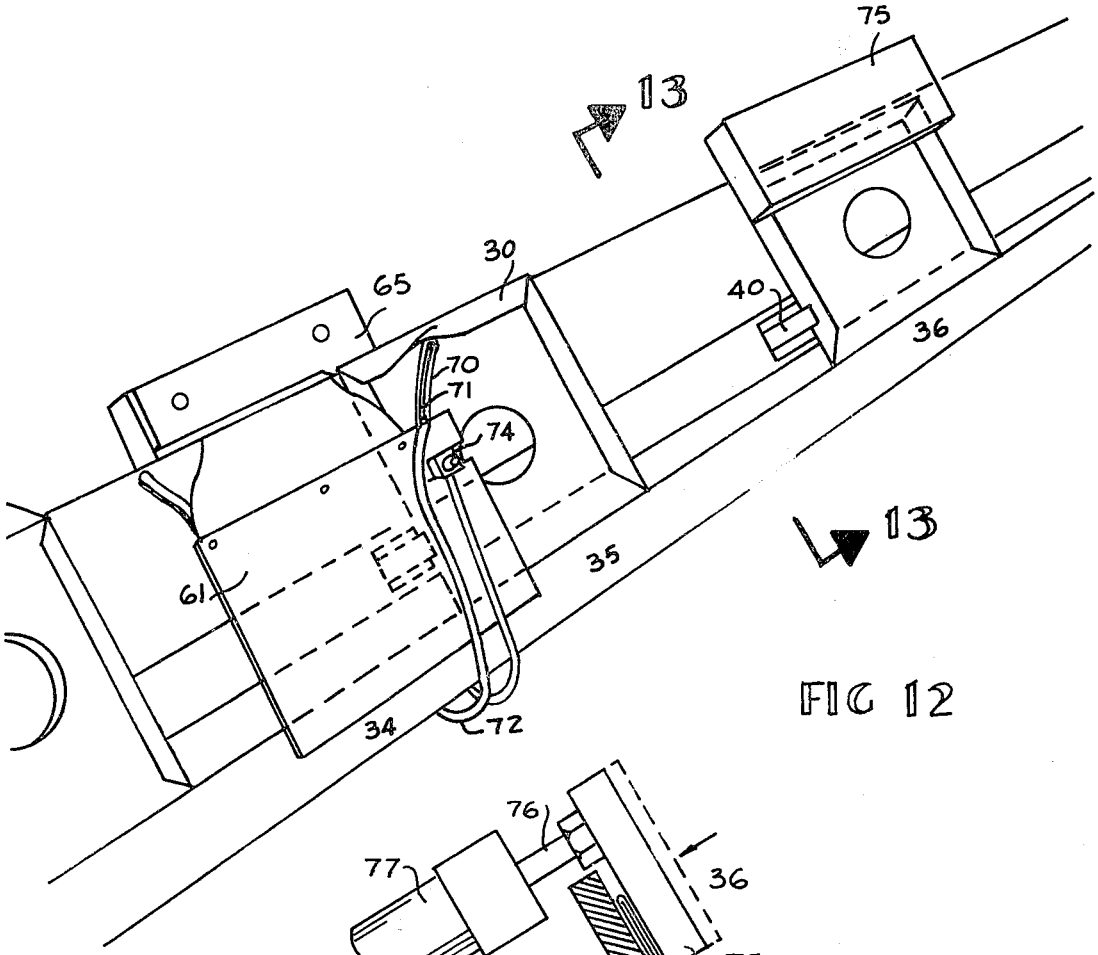
FIG. 12 is a partial perspective view of the platen showing disc covers at various stations.

With movement of the dolly, the disc cover with the flap 30—now folded dowm 180°—is shifted to the right and the arm 70 slips beneath the flap 30 in the manner shown in FIG. 12. Simultaneously a photoelectric cell 74 detects the pressure of the disc cover and energizes the glue supply to cause glue to flow through the tube 72 and the nozzle 71. The glue is deposited on the underside of the flap 30 as the disc cover moves past. The dolly comes to a stop with the disc cover at the clamping station 36.

The clamping station 36 (FIG. 13) serves to clamp the folded flap 30 against the side panel 21 and hold it in this position momentarily to allow the glue to spread out and set sufficiently such that the flap remains sealed. For this purpose there is positioned outward from the top edge of the platen a press member 75 supported by an actuating arm 76 extending from an actuator 77. When the disc cover reaches the holding station 36, the actuator 77 is energized to pull the arm 75 towards the platen and press the top flap 30 against the wall 21 of the disc cover. This action serves to form a tight joint between the flap and the wall member and also to cool the fold line by the close contact with the metal mass. Proper spacing between the sidewalls is maintained by the presence of the disc within the cover. Cooling of the glue causesit to set sufficiently to hold the flap in place. After a few seconds' duration, the press is moved away from the platen and the dolly once again is energized to shift the disc cover from the press station to the unloading station.

In the manner just described, a disc cover is moved through the machine while the various functions are performed at the stations described. Of course there is a disc cover at each station with the functions being performed simultaneously such that four disc covers are actually on the platen in various stages of being sealed prior to being discharged. Thus in one continuous operation each disc cover is sealed with the recording media inside in a manner to allow room for the recording media and also to prevent glue from reaching the inside pocket of the disc cover. By performing the folding operation before the glue is deposited, a mandrel can be utilized and no glue contaminates the folding station.

Additionally this assures that there is little or no likelihood of glue reaching the inside pocket of the cover and the recording media.

I claim:

1. A machine for sealing a disc cover having first and second parallel-positioned walls for enclosing a disc and a flap fixed to the first wall and extending beyond both walls to be folded over at a fold line and glued to the second wall, said machine comprising:

a platen to hold the disc cover; means to heat said flap fold line;

a folding arm configured to contact the flap;

an actuator connected to said folding arm and energizable to move said folding arm against said flap and fold the flap over said second wall;

a glue system comprising;

a glue nozzle;

means supporting said glue nozzle for passage between said folded flap and said second wall;

means to supply glue to said glue nozzle to be deposited between said flap and second wall as said nozzle is passed therebetween; and means to press said flap against said second wall to form a close bond therebetween.

2. A machine as defined in claim 1 including a mandrel mounted to press against said second wallwhile said flap is folded.

3. A machine as defined in claim 2 including means to move said mandrel and second wallout of contact prior to said glue nozzle being passed between the second wall and said flap.

* * * * *